United States Patent [19]

Voss

[11] Patent Number: 4,658,880

[45] Date of Patent: Apr. 21, 1987

[54] COUNTERGRAVITY CASTING APPARATUS

[75] Inventor: Karl D. Voss, Standish, Mich.

[73] Assignee: General Motors Corporation, Detroit, Mich.

[21] Appl. No.: 872,010

[22] Filed: Jun. 9, 1986

Related U.S. Application Data

[63] Continuation-in-part of Ser. No. 806,619, Dec. 9, 1985, abandoned.

[51] Int. Cl.[4] ..... B22D 18/06

[52] U.S. Cl. ..... 164/255; 164/63; 164/256

[58] Field of Search ..... 164/255, 254, 256, 63, 164/65

[56] References Cited

U.S. PATENT DOCUMENTS 2,997,756 8/1961 Strom ..... 164/256 X 4,508,157 4/1985 Belliveau et al. ..... 164/63

*Primary Examiner*—Nicholas P. Godici

*Assistant Examiner*—J. Reed Batten, Jr.

*Attorney, Agent, or Firm*—Lawrence B. Plant

[57] ABSTRACT

Apparatus for the vacuum, countergravity casting of metal in shell molds including a gas-permeable shell mold secured to the mouth of a vacuum box by a plurality of threadable mounting sites atop the mold engaged by self-tapping threads on the ends of rotatable shafts reciprocably slidable through the ceiling of the vacuum box.The mounting sites may comprise upstanding lugs atop the mold.

6 Claims, 3 Drawing Figures

COUNTERGRAVITY CASTING APPARATUS

This is a Continuation-In-Part of U.S. Ser. No. 806,619 filed December 9, 1985 and now abandoned.

This invention relates to apparatus for the vacuum, countergravity casting of metal in gas-permeable, shell molds and, more particularly, to means for mounting the mold to the vacuum chamber used therewith.

BACKGROUND OF THE INVENTION

The vacuum, countergravity, shell mold casting process is particularly useful in the making of thin-walled castings and involves: sealing a bottom-gated mold, having a gas-permeable upper portion, to the mouth of a vacuum chamber such that the chamber confronts the upper portion; immersing the underside of the mold in an underlying melt; and evacuating the chamber to draw melt up into the mold through one or more of the gates in the underside thereof. Such a process is shown in U.S. Pat. No. 4,340,108 wherein the mold comprises a resin-bonded-sand shell having an upper cope portion and a lower drag portion sealingly bonded together and attached to the vacuum chamber by means of spring clips which engage a peripheral abutment on the outside of the vacuum chamber. U.S. Pat. No. 4,340,108 seals the mold to the vacuum chamber atop the cope such that the parting line between the mold halves lies outside the vacuum chamber. Copending U.S. Pat. application Ser. No. 654,404, filed September 26, 1984 in the name of Roger Almond and assigned to the assignee of the present invention, seals the mold to the vacuum chamber atop the drag such that the parting line between the cope and drag falls within the vacuum chamber. U.S. Ser. No. 654,404 uses spring biased bolts engaging the underside of the drag and extending along the outside of the vacuum chamber to secure the mold to the vacuum chamber. The heads of the bolts are immersed in the melt and accordingly have a very short useful life. Finally, Chandley G. D., *Automatic Counter Gravity Casting of Shell Molds*, Modern Casting, October 1983, pages 29–31, describes a technique for mounting round molds to a round vacuum chamber wherein the inside surface of the vacuum chamber includes self-tapping threads which screw into the periphery of the round mold. The latter technique has been restricted to relatively small molds and cannot be used with molds which are rectangular or have other than a round exterior.

It is an object of the present invention to provide apparatus for the vacuum, countergravity casting of shell molds including improved means for automatically mounting the shell mold to the mouth of the vacuum box without deterioration of the mounting means and regardless of the shape or size of the mold and the vacuum chamber. This and other objects and advantages of the present invention will become more readily apparent from the detailed description thereof which follows.

Brief Description of the Invention

The invention comprehends an improved vacuum, countergravity casting apparatus including: a mold having a porous, gas-permeable upper shell and a bottom-gated lower portion secured to the upper shell; a vacuum box defining a chamber confronting the upper shell for evacuating the mold through the shell, which box comprises a peripheral wall having a lip on the underside thereof for sealingly engaging the mold and a ceiling overlying the mold; a plurality of threadable mounting sites atop the mold; and retainer means reciprocably slidable through the ceiling of the box, said retainer means comprising a plurality of shafts extending sealingly through the ceiling, self-tapping threads on the lower end of each shaft engaging a mounting site registered therewith, and a means for rotating the shaft so as to screw the threads into engagement/disengagement with the mounting site as is appropriate for mounting and demounting the mold to the vacuum chamber. According to one embodiment of the invention the mounting sites each comprise an upstanding lug and the lower end of the shaft comprises an inverted cup having female threads on the inside thereof for threading into the outside surface of the lugs. In another embodiment of the invention, the lower end of each shaft is provided with a male threaded tip for screwing into the mounting site. In this latter embodiment, the mounting site may be an upstanding lug similar to that of the first embodiment, or may simply be a location on the main body of the mold where the threaded tip can burrow into the mold without upsetting the molding cavity. A rotator (e.g., air motor) on the other end of the shaft causes the shaft to rotate in the desired direction for screwing the threads onto/into the mounting sites so as to draw the mold up into sealing engagement with the mouth of the vacuum chamber.

BRIEF DESCRIPTION OF THE DRAWINGS

The invention may better be understood when considered in the light of the following detailed description of certain specific embodiments thereof which are given hereafter in conjunction with the several drawings.

DETAILED DESCRIPTION OF THE PREFERRED EMBODIMENT

Figure 1:
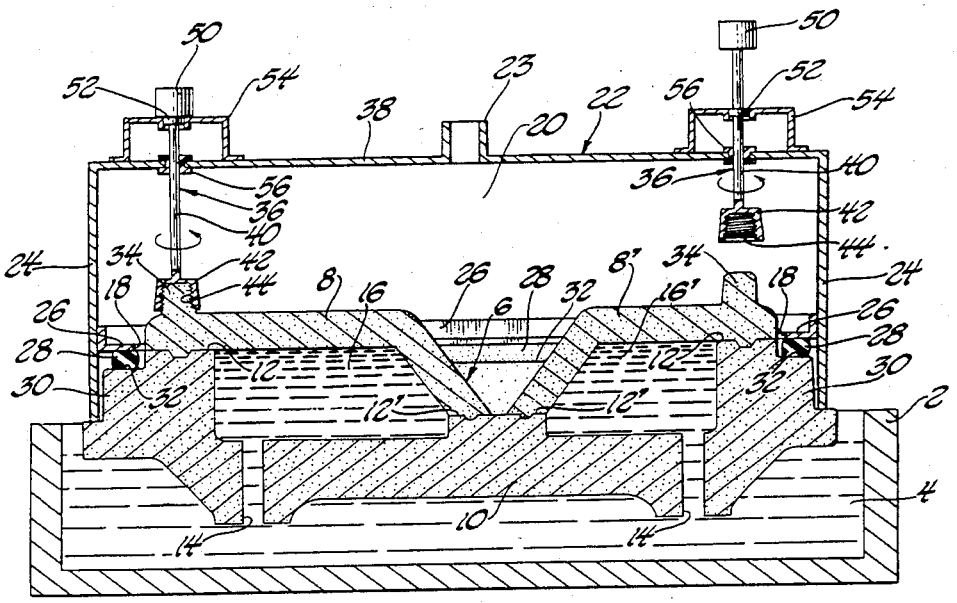
FIGS. 1, 2 and 3 are side, sectioned views through different embodiments of a vacuum, countergravity metal casting apparatus in accordance with the present invention.
Figure 2:
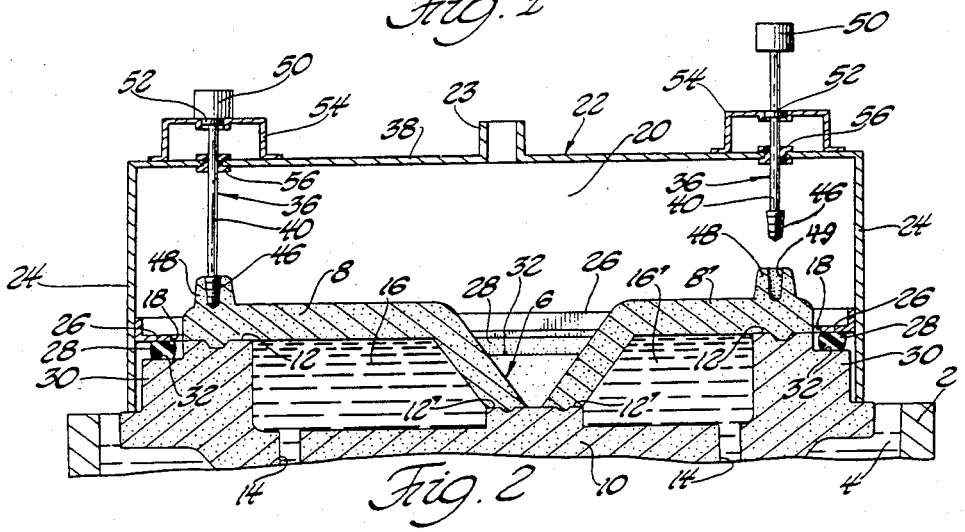
Figure 3:
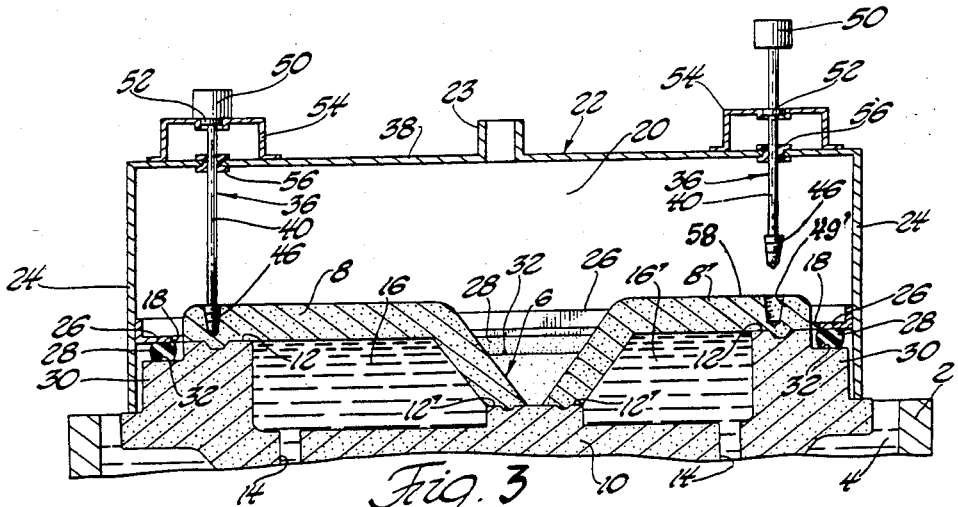

FIGS. 1, 2 and 3 differ one from the other only with respect to the precise nature of the mounting sites used to anchor the mold to the vacuum chamber. Accordingly, like reference numerals are used for like parts in all three Figures and different reference numerals are used only where the Figures differ from each other. The several Figures show a pot 2 of metal melt 4 which is to be drawn up into the mold 6. The mold 6 includes gas-permeable, upper portions 8 and 8' joined (e.g., glued) to a lower portion 10 along parting lines 12 and 12' and define therebetween separate molding cavities 16 and 16'. The lower portion 10 includes a plurality of ingates 14 on the underside thereof for supplying melt to the mold cavities 16 and 16' when the cavities are evacuated. The lower portion 10 of the mold 6 is sealed to the mouth 18 of a vacuum chamber 20, which is defined by vacuum box 22, such that the gas-permeable upper portions 8 and 8' are encompassed by the chamber 20. The vacuum chamber 20 is communicated to a vacuum source (not shown) via conduit 23. The upper portions 8 and 8' of the mold 6 comprise a gas-permeable material (e.g., resin-bonded-sand) which permits gases to be withdrawn from the casting cavities 16 and 16' when a vacuum is drawn in the chamber 20. The lower portion 10 of the mold 6 may conveniently comprise the same material as the upper portions 8 and 8', or other materials, permeable or impermeable, which are compatible with the upper portion material.

Pieces of angle iron 26 are welded to the inside of the walls 24 of the box 22 so as to provide a continuous, inwardly projecting shelf or lip defining the mouth 18 of the vacuum chamber 20. A continuous, elastomeric gasket 28 (e.g silicone or fluoroelastomer rubber) is secured (e.g., glued) to the underside of the shelf 26 for effecting a seal between the mouth 18 of the vacuum chamber 20 and the mold 6.

The lower portion 10 of the mold 6 includes a continuous upstanding ridge 30 having an upper sealing surface 32 for engaging the elastomeric gasket 28 and compressing it against the shelf 26 when the mold 6 is secured to the vacuum box 22.

In accordance with one embodiment of the present invention, upstanding mounting lugs 34 are provided atop the upper portions 8, 8' of the mold 6 which lugs 34 are adapted to be threaded by self-tapping threads on the ends of the anchoring means 36 which extend through the ceiling 38 of the vacuum chamber 20. In the particular version of that embodiment shown in FIG. 1, the anchoring means 36 comprises a rotatable shaft 40 having an inverted cup 42 on the lower end thereof which, in turn, has self-tapping, female threads 44 on the inside surface thereof. Upon rotation of the shaft 40, the threads are screwed into the outside surface of the upstanding mounting lugs 34. In another version of that embodiment (shown in FIG. 2), the lower end of the shaft 40 is provided with a tip 46 having male, self-tapping threads on the outside thereof which, upon rotation of the shaft 40, screw into the center of the studs 48. The lugs 48 will preferably be predrilled to provide an undersized socket 49 for receiving the tip 46 therein and thereby reduce the risk of splitting the stud part during engagement with the tip 46. The shafts 40, for both embodiments, have motors 50 on the opposite ends thereof for rotating the shafts 40 so as to engage and disengage the threads from the mounting lugs. The shaft 40 of each anchoring means 36 is slidable up or down through the center of the bearings 52 carried by the mounting bracket 54 and through the rubber (e.g., silicone) sealing grommet 56.

The embodiment shown in FIG. 3 is similar to that of FIG. 2 except that the mounting lugs 48 are eliminated and the sockets 49' provided directly into the main body of the mold 6 through the top surface 58 thereof.

In operation, the mouth of the vacuum chamber 20 is lowered down onto the mold 6. Thereafter, the anchoring means 36 is caused, by any convenient means (not shown), to descend into engagement with the lugs 34 or 48, registered therewith, and the shafts 40 rotated (e.g., clockwise) to screw the threads 44 or 46 onto/into the lugs 34 or 48 respectively and thereby draw the mold 6 up tightly against the gasket 28. After casting, the shafts 40 are rotated in the opposite direction (e.g., counterclockwise) to release the mold 6.

While the invention has been disclosed primarily in terms of a specific embodiment thereof it is not intended to be limited thereto but rather only to the extent set forth hereafter in the claims which follow.

The embodiments of the invention in which an exclusive property or privilege is claimed are defined as follows:

1. Apparatus for the vacuum, countergravity casting of molten metal comprising:

a mold comprising a porous, gas-permeable upper shell at least in part defining a molding cavity, and a bottom-gated lower portion secured to said upper shell for admitting said metal into said cavity from an underlying pot of said metal;

a plurality of integral, threadable mounting lugs atop said mold;

a vacuum box sealingly engaging said mold and defining therewith a vacuum chamber confronting said upper shell for evacuating said cavity through said shell, said box having a ceiling overlying said mold;

means reciprocally slidable through said ceiling for engaging each of said lugs so as to anchor said mold in said chamber, said means comprising a plurality of shafts extending through said ceiling, self-tapping threads on the lower end of each said shaft for engaging a said lug registered therewith and rotator means operatively associated with each said shaft for screwing said threads into engagement/disengagement with said lug to respectively mount/demount said mold to/from said box.

2. Apparatus for the vacuum countergravity casting of molten metal comprising:

a mold comprising a porous, gas-permeable upper shell at least in part defining a molding cavity and a bottom-gated lower portion secured to said upper shell for admitting said metal into said cavity from an underlying pot of said metal;

a plurality of integral, threadable mounting lugs atop said mold;

a vacuum box sealingly engaging said mold and defining therewith a vacuum chamber confronting said upper shell for evacuating said cavity through said shell, said box having a ceiling overlying said mold;

means reciprocally slidable through said ceiling for engaging each of said lugs so as to anchor said mold in said chamber, said means comprising a plurality of shafts extending through said ceiling, self-tapping threads on the lower end of each said shaft for engaging a said lug registered therewith and a reversible motor on substantially the other end of each said shaft for screwing said threads into engagement/disengagement with said lug to respectively mount/demount said mold to/from said box.

3. Apparatus according to claim 1 or 2 wherein the lower end of said shaft comprises an inverted cup and said self-tapping threads comprise female threads on the inside of said cup for screwing into the outside surface of said lug.

4. Apparatus according to claim 1 or 2 wherein said self-tapping threads comprise male threads for screwing internally into said lug.

5. Apparatus for the vacuum, countergravity casting of molten metal comprising:

a mold comprising a porous, gas-permeable upper shell at least in part defining a molding cavity, and a bottom-gated lower portion secured to said upper shell for admitting said metal into said cavity from an underlying pot of said metal;

a plurality of threadable mounting sites atop said mold;

a vacuum box sealingly engaging said mold and defining therewith a vacuum chamber confronting said upper shell for evacuating said cavity through said shell, said box having a ceiling overlying said mold;

means reciprocally slidable through said ceiling for engaging each of said sites so as to anchor said mold in said chamber, said means comprising a plurality of shafts extending through said ceiling, self-tapping threads on the lower end of each said shaft for engaging a said site registered therewith and rotator means operatively associated with each said shaft for screwing said threads into engagement/disengagement with said site to respectively mount/demount said mold to/from said box.

6. Apparatus for the vacuum, countergravity casting of molten metal comprising:

a mold comprising a porous, gas-permeable upper shell at least in part defining a molding cavity, and a bottom-gated lower portion secured to said upper shell for admitting said metal into said cavity from an underlying pot of said metal;

a plurality of internally threadable sockets atop said mold;

a vacuum box sealingly engaging said mold and defining therewith a vacuum chamber confronting said upper shell for evacuating said cavity through said shell, said box having a ceiling overlying said mold;

means reciprocally slidable through said ceiling for engaging each of said sockets so as to anchor said mold in said chamber, said means comprising a plurality of shafts extending through said ceiling, self-tapping external threads on the lower end of each said shaft for engaging a said socket registered therewith and rotator means operatively associated with each said shaft for screwing said threads into engagement/disengagement with said socket to respectively mount/demount said mold to/from said box.

* * * * *